US005365857A

United States Patent [19]

Kilpatrick et al.

[11] Patent Number: 5,365,857

[45] Date of Patent: Nov. 22, 1994

[54] PALLET STRINGER

[75] Inventors: Ted D. Kilpatrick, Ponte Vedra Beach, Fla.; Arthur M. Wagner, Geneva, Ill.; Donald G. Young, La Crosse, Ind.

[73] Assignee: Gate Pallet Systems, Inc., Crown Point, Ind.

[21] Appl. No.: 38,001

[22] Filed: Mar. 29, 1993

[51] Int. Cl.[5] ..... B65D 19/00

[52] U.S. Cl. ..... 108/51.3; 108/56.1

[58] Field of Search ..... 108/51.3, 51.1, 56.3, 108/56.1

[56] References Cited

U.S. PATENT DOCUMENTS

| | | | |
|---|---|---|---|
| 2,728,545 | 12/1955 | Hermitage | 248/120 |
| 3,464,371 | 9/1969 | Gifford | 108/57 |
| 3,659,534 | 5/1972 | Childs | 108/56 |
| 3,683,822 | 8/1972 | Roberts et al. | 108/56 |
| 4,102,525 | 7/1978 | Albano | 248/174 |
| 4,563,377 | 1/1986 | Melli | 428/36 |
| 4,792,325 | 12/1988 | Schmidtke | 493/334 |
| 4,867,074 | 9/1989 | Quasnick | 108/51.3 |
| 5,001,991 | 3/1991 | Smith | 108/51.3 |

FOREIGN PATENT DOCUMENTS

| | | |
|---|---|---|
| 84906 | 5/1986 | European Pat. Off. . |
| 2152068 | 3/1973 | France . |
| 512367 | 10/1971 | Switzerland . |
| 620701 | 3/1949 | United Kingdom . |

*Primary Examiner*—Peter R. Brown
*Assistant Examiner*—Gerald A. Anderson
*Attorney, Agent, or Firm*—Dressler, Goldsmith, Shore & Milnamow, Ltd.

[57] ABSTRACT

A pallet stringer, generally trapezoidal when viewed endwise, is folded from a corrugated paperboard sheet to have five panels on each side of a vertical plane and a lower panel intersected by the plane, namely an outer panel extending upwardly and outwardly from the lower panel, another outer panel extending inwardly from the upwardly extending outer panel, toward the plane, an inner panel extending downwardly from the inwardly extending outer panel, toward the lower panel, another inner panel extending upwardly and outwardly from the downwardly extending panel, toward the inwardly extending outer panel, at an acute angle relative to the downwardly extending panel, and an inner panel extending inwardly from the upwardly and outwardly extending inner panel, toward the downwardly extending inner panel. The inwardly extending inner panels may have tabs extending into decking member apertures in other panels. Certain panels are secured adhesively to other panels.

10 Claims, 2 Drawing Sheets

Fig. 1
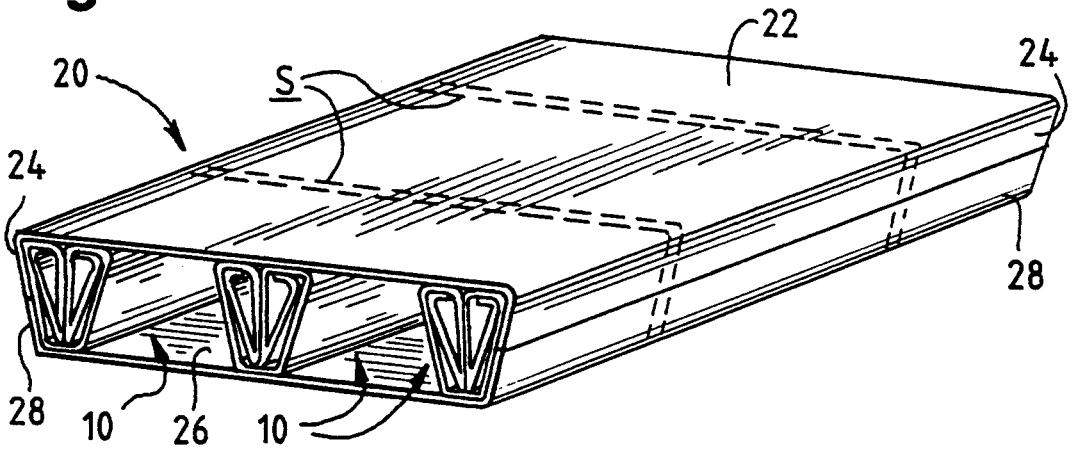
Fig. 2
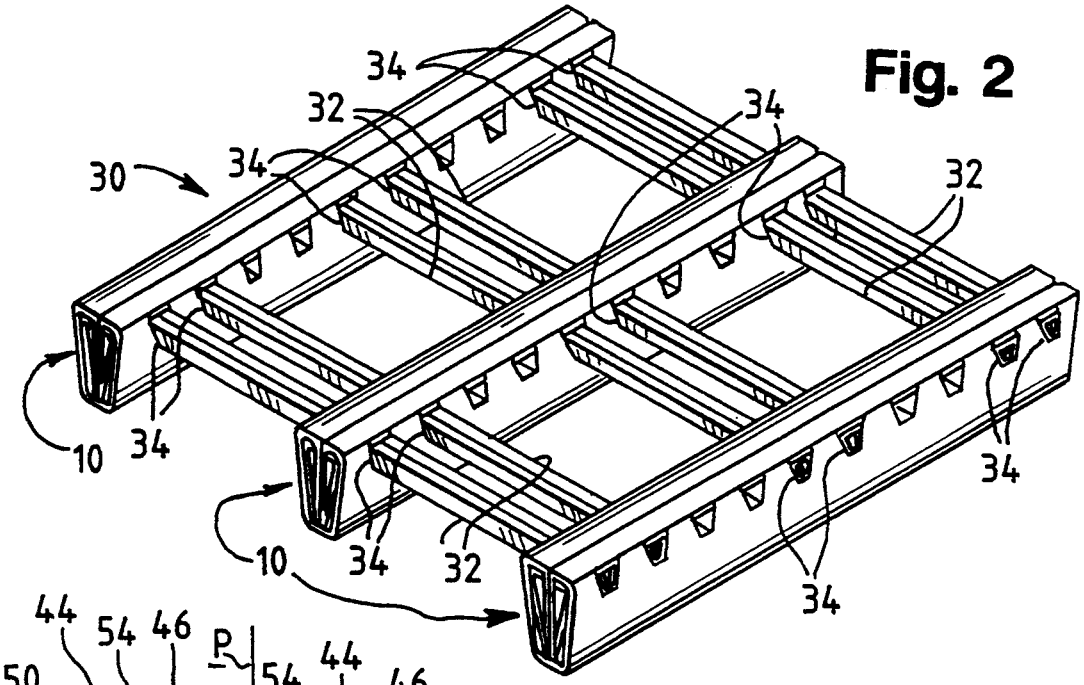
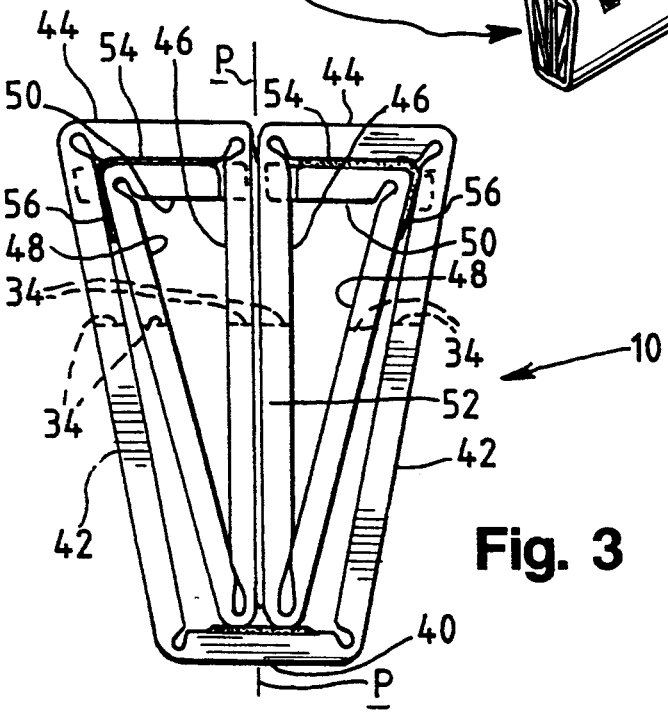
Fig. 3

Fig. 4
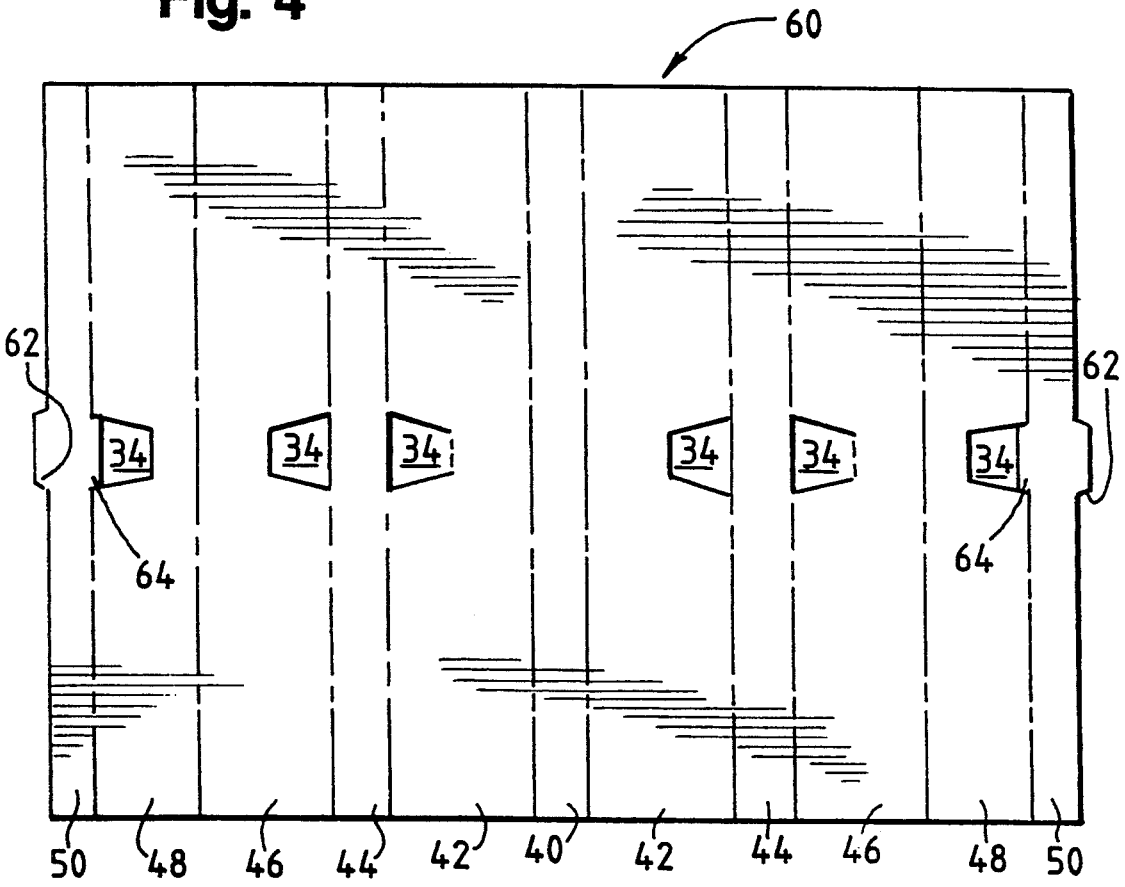
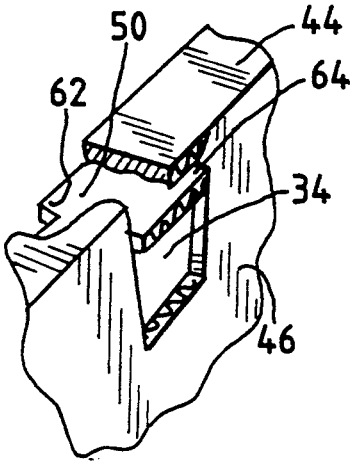
Fig. 5
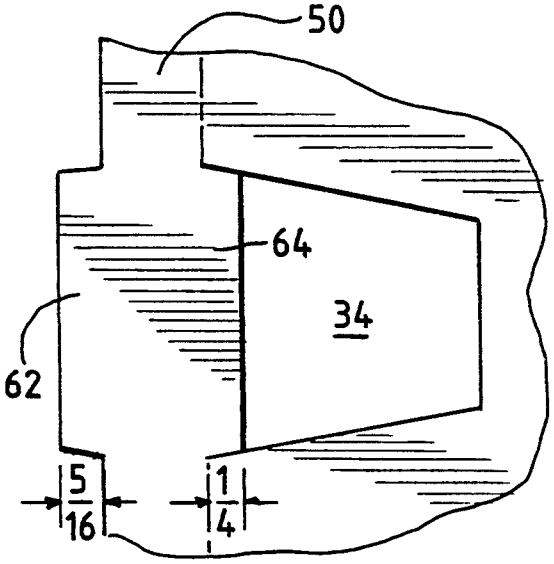
Fig. 6

PALLET STRINGER

TECHNICAL FIELD OF THE INVENTION

This invention pertains to an improved stringer for a pallet of a type made predominantly of paperboard material, such as corrugated paperboard or multi-ply paper. The improved stringer exhibits high compressive strength and good lateral stability.

BACKGROUND OF THE INVENTION

As made predominantly of corrugated paperboard, multi-ply paper, or similar material, pallets of the type noted above and methods for their manufacture are exemplified in Schmidtke U.S. Pat. No. 4,792,325, Quasnick U.S. Pat. No. 4,867,074, and Smith U.S. Pat. No. 5,001,991. Typically, such a pallet comprises elongate stringers and decking members, each having a desired configuration when viewed endwise.

As disclosed in each of these patents, each stringer has a generally trapezoidal configuration when viewed endwise, as a result of a sheet of corrugated paperboard, multi-ply paper, or similar material having been folded to form multiple panels, which define two symmetrical halves of such stringer. Moreover, in each stringer, certain panels are secured adhesively to other panels.

Pallets employing such stringers are available commercially from Gate Pallet Systems, Inc. of Crown Point, Ind., under its PAYLOAD trademark. Efforts to improve such pallets by improving the stringers used in such pallets have led to this invention.

Other pallets of related interest are disclosed in Hermitage U.S. Pat. No. 2,728,545, Roberts et al. U.S. Pat. No. 3,683,822, Melli U.S. Pat. No. 4,563,377, and Atterby et al. U.S. Pat. No. 4,802,421.

SUMMARY OF THE INVENTION

This invention provides an improved stringer for a pallet made predominantly of paperboard material, such as corrugated paperboard or multi-ply paper. The improved pallet is folded from a single sheet of such material so as to have at least eleven panels. These panels include five panels on each side of a generally vertical plane and a lower panel intersected by the generally vertical plane.

On each side of the generally vertical plane, an outer panel extends upwardly from the lower panel and an outer panel extends inwardly from the upwardly extending outer panel, toward and approximately to the generally vertical plane. Also, an inner panel extends downwardly from the inwardly extending outer panel, toward and approximately to the lower panel. Moreover, an inner panel extends upwardly and outwardly from the downwardly extending inner panel, toward and approximately to the inwardly extending outer panel, at an acute angle relative to the downwardly extending inner panel. Furthermore, an inner panel extends inwardly from the upwardly and outwardly extending inner panel, toward and approximately to the downwardly extending inner panel.

Preferably, the inwardly extending inner panel on each side of the generally vertical plane is secured adhesively to the inwardly extending outer panel on the same side. Preferably, moreover, the downwardly extending inner panel on each side of the vertical plane is secured adhesively to the downwardly extending inner panel on the other side.

Desirably, the outer panel extending upwardly from the lower panel on each side of the generally vertical plane extends upwardly and outwardly at an obtuse angle relative to the lower panel. Thus, the pallet stringer is generally trapezoidal when viewed endwise.

A plurality of the improved stringers can be advantageously combined with a plurality of decking members made predominantly of paperboard material, such as the decking members disclosed in the Schmidtke patent noted above, to form a predominantly paperboard pallet.

Desirably, when the improved stringer is combined with a decking member extending through aligned apertures in the upwardly extending outer panels, the downwardly extending inner panels, and the upwardly and outwardly extending inner panels, the decking member is secured adhesively to the inwardly extending inner panels. Preferably, each inwardly extending inner panel has a tab extending into at least one of said apertures, above the decking member. More preferably, each inwardly extending inner panel has tabs extending into the aligned apertures in the upwardly extending outer panel and the downwardly extending inner panel, above the decking member.

A plurality of the improved stringers can be alternatively combined with an upper sheet of paperboard material or with upper and lower sheets of paperboard material, as disclosed in a commonly owned, copending application, U.S. patent application Ser. No. 07/906,356 filed Jun. 30, 1992, to form a predominantly paperboard pallet.

Whether employing such decking members, such an upper sheet, or such upper and lower sheets, a predominantly paperboard pallet employing the improved stringers exhibits high compressive strength and good lateral stability.

These and other objects, features, and advantages of this invention are evident from the following description of a preferred embodiment of this invention with reference to the accompanying drawings.

BRIEF DESCRIPTION OF THE DRAWINGS

FIG. 1 is a perspective view of a predominantly paperboard pallet employing three improved stringers according to this invention together with an upper sheet and a lower sheet. Optional reinforcing straps are shown in dashed lines.

FIG. 2 is a perspective view of a predominantly paperboard pallet employing three improved stringers according to this invention together with three pairs of decking members.

FIG. 3 is an end view of an improved stringer according to this invention, as used in the pallet of FIG. 2.

FIG. 4 is a plan view of a blank of corrugated paperboard, as used to make the apertured stringers of the pallet of FIG. 2.

FIG. 5 is an enlarged, fragmentary detail of one half of an apertured stringer made from the blank of FIG. 4.

FIG. 6 is an enlarged, fragmentary detail of one edge of the blank, as shown in FIG. 4.

DETAILED DESCRIPTION OF PREFERRED EMBODIMENT

As shown in the drawings, an improved stringer 10 constituting a preferred embodiment of this invention is useful in making a predominantly paperboard pallet exhibiting high compressive strength and good lateral stability.

Thus, in one such pallet 20 shown in FIG. 1, three such stringers 10 are combined with an upper sheet 22 having two outer flaps 24 folded downwardly and with a lower sheet 26 having two outer flaps 28 folded upwardly. The upper and lower sheets 22, 26, and the outer flaps 24, 28, are secured adhesively to the stringers 10. Optional reinforcing straps S are shown in dashed lines. Except for the stringers 10, the pallet 20 is similar to a pallet illustrated and described in the copending application noted above, the disclosure of which is incorporated herein by reference.

Also, in another such pallet 30 shown in FIG. 2, three such stringers 10 are combined with three pairs of decking members 32 extending through apertures 34 in the stringers 10. The decking members 32 are secured adhesively to the stringers 10 at margins of the apertures 34. Each decking member 32 is folded from a single sheet of paperboard material, such as the material used for the stringers 10, so as to have multiple panels, some of which panels are secured adhesively to other panels of such decking member 32. Each decking member 32 is similar to the decking members disclosed in the Schmidtke patent noted above. Except for the stringers 10, the pallet 30 is similar to the pallets disclosed in the Quasnick and Schmidtke patents noted above, the disclosures of which patents are incorporated herein by reference.

The improved stringer 10 is folded from a single sheet of double wall, corrugated paperboard, which may be tape-reinforced or fiber-reinforced. Single wall, corrugated paperboard or multi-ply paper may be alternatively used.

Herein, directional terms including "upper", "lower", "vertical", "horizontal", "upwardly", "downwardly", "inwardly", and "outwardly" refer to the improved stringer 10 and the pallets 20, 30, in preferred orientations, in which they are shown. The improved stringer 10 and the pallets 20, 30, would be also useful in inverted orientations. Usage of such directional terms is not intended to restrict this invention to the preferred orientation.

As shown in FIG. 3, the improved stringer 10 is folded so as to have eleven panels, namely five panels on each side of an imaginary, generally vertical plane P and a generally horizontal, lower panel 40, which is intersected by the plane P. Also, as shown in FIG. 3, the lower panel 40 is bisected by the plane P. Preferably, as shown, the improved stringer 10 is folded along parallel folding lines extending in a transverse direction relative to flutes of the single sheet of corrugated paperboard.

On each side of the plane P, an outer panel 42 extends upwardly and outwardly from the lower panel 40, at an obtuse angle relative to the lower panel 40. Also, an outer panel 44 extends inwardly from the upwardly extending outer panel 42, toward and approximately to the plane P. Further, an inner panel 46 extends downwardly from the inwardly extending outer panel 44, toward and approximately to the lower panel 40. Moreover, an inner panel 48 extends upwardly and outwardly from the downwardly extending inner panel 46, toward and approximately to the inwardly extending outer panel 44, at an acute angle relative to the downwardly extending inner panel 46. Furthermore, an inner panel 50 extends inwardly from the upwardly and outwardly extending inner panel 48, toward and approximately to the downwardly extending inner panel 46.

As shown in FIG. 3, the downwardly extending inner panel 46 on each side of the plane P is secured adhesively to the downwardly extending inner panel 46 on the opposite side, in a wide region 52 between the panels 46. Also, the inwardly extending inner panel 50 on each side of the plane P is secured adhesively to the inwardly extending outer panel 44 on the same side, in a wide region 54 between the panel 50 and the panel 44. Moreover, the upwardly and outwardly extending inner panel 48 on each side of the plane P is secured adhesively to the upwardly and outwardly extending outer panel 42 on the same side, in a region 56 near the inwardly extending outer panel 44 on the same side. Furthermore, on each side of the plane P, the adhesive applied in the region 54 and the adhesive applied in the region 56 may be contiguously applied.

Preferably, the adhesive applied in the regions 52, 54, 56, is a so-called "cold melt" or "cold set" adhesive, such as Code No. 3715 or Code No. 3715B, both of which are available commercially from H. B. Fuller Co. of Palatine, Ill.

In the pallet 30, which is shown in FIG. 2, the apertures 34 are located so as to permit the decking members 32 to pass closely beneath the inwardly extending inner panels 50 of the respective stringers 10. Preferably, the upper surfaces of the decking members 32 are secured adhesively to those panels 50 of the respective stringers, by one of the adhesives noted in the preceding paragraph.

As shown in FIG. 3, because each of the outer panels 42 extend upwardly and outwardly at an obtuse angle relative to the lower panel 40, the improved stringer 10 is generally trapezoidal, when viewed endwise. Moreover, the improved stringer 10 is generally symmetrical on opposite sides of the plane P, when viewed endwise.

As illustrated in FIG. 4, a representative stringer 10 of the pallet 30 is made by die-cutting and folding, along folding lines indicated by broken lines in FIG. 4, a corrugated paperboard blank 60 and by adhesively securing certain panels of the blank 60 to other panels of the blank 60, as described previously. On each side of the plane P, the inwardly extending inner panel 48 has two oppositely extending tabs associated with the aligned apertures 34 to receive each decking member 32, namely a tab 62 extending into the aperture 34 in the upwardly and outwardly extending outer panel 42 on the same side and a tab 64 extending into the aperture 34 in the downwardly extending inner panel 46 on the same side. Moreover, the upper surfaces of the decking members 32 are secured adhesively to the tabs 62, 64, as well as to the aforesaid panels 48 by one of the adhesives noted previously. The tabs 62, 64, provide larger areas for adhesive securement of the decking members 32.

Each stringer 10 of the pallet 20 is similar to each stringer 10 of the pallet 30, as described above, except that the apertures 34 and the tabs 62, 64, may be optionally omitted. In the pallet 20, as shown in FIG. 1, the apertures 34 and the tabs 62, 64, have been omitted.

With or without the apertures 34 and the tabs 62, 64, the improved stringer 10 compares favorably in compressive strength and provides greater lateral stability but requires less material as compared to a stringer having similar overall dimensions and having eleven panels folded and secured adhesively as disclosed in the Quasnick patent noted above.

The improved stringer 10 can be additionally stabilized with tubular reinforcing pieces, as disclosed in Smith U.S. Pat. No. 5,001,991.

Various modifications may be made in the preferred embodiment described above without departing from the scope and spirit of this invention.

We claim:

1. A pallet stringer folded from a single sheet of paperboard material so as to have at least eleven panels, which include five panels on each side of a generally vertical plane and a lower panel intersected by the generally vertical plane, wherein the panels on each side include (a) an outer panel attached at a fold in the sheet to and extending upwardly from the lower panel, (b) an outer panel attached at a fold in the sheet to and extending inwardly from the upwardly extending panel, and extending toward and approximately to the generally vertical plane, (c) an inner panel attached to a fold in the sheet to and extending downwardly from the inwardly extending outer panel, and extending toward and approximately to the lower panel, (d) an inner panel attached at a fold in the sheet to and extending upwardly and outwardly from the downwardly extending inner panel, and extending toward and approximately to the inwardly extending outer panel, at an acute angle relative to the downwardly extending inner panel, (e) and an inner panel attached at a fold in the sheet to and extending inwardly from the upwardly and outwardly extending inner panel, and extending toward and approximately to the downwardly extending inner panel.

2. The pallet stringer of claim 1 wherein the inwardly extending inner panel on each side of the generally vertical plane is secured adhesively to the inwardly extending outer panel on said side.

3. The pallet stringer of claim 3 wherein the upwardly and outwardly extending inner panel on each side of the generally vertical plane also is secured adhesively to the upwardly extending outer panel on said side, near the inwardly extending panel on said side.

4. The pallet stringer of claim 3 wherein the upwardly and outwardly extending panel on each side of the vertical plane also is secured adhesively to the upwardly extending outer panel on the same side, near the inwardly extending outer panel on the same side.

5. The pallet stringer of claim 3 wherein the outer panel extending upwardly from the lower panel on each side of the generally vertical plane extends upwardly and outwardly at an obtuse angle relative to the lower panel, the pallet stringer being generally trapezoidal when viewed endwise.

6. A pallet stringer folded from a single sheet of paperboard material so as to have at least eleven panels, which include five panels on each side of a generally vertical plane and a lower panel intersected by the generally vertical plane, wherein the panels on each side include (a) an outer panel extending upwardly from the lower panel, (b) an outer panel extending inwardly from the upwardly extending panel, toward and approximately to the generally vertical plane, (c) an inner panel extending downwardly from the inwardly extending outer panel, toward and approximately to the lower panel, (d) an inner panel extending upwardly and outwardly from the downwardly extending inner panel, and approximately to the inwardly extending outer panel, at an acute angle relative to the downwardly extending inner panel, (e) and an inner panel extending inwardly from the upwardly and outwardly extending inner panel, and approximately to the downwardly extending inner panel, wherein the pallet stringer is combined with a decking member extending through aligned apertures in the upwardly extending outer panels, the downwardly extending inner panels, and the upwardly and outwardly extending inner panels, the decking member being secured adhesively to the inwardly extending inner panels.

7. A pallet stringer folded from a single sheet of paperboard material so as to have at least eleven panels, which include five panels on each side of a generally vertical plane and a lower panel intersected by the generally vertical plane, wherein the panels on each side include (a) an outer panel extending upwardly from the lower panel, (b) an outer panel extending inwardly from the upwardly extending panel, toward and approximately to the generally vertical plane, (c) an inner panel extending downwardly from the inwardly extending outer panel, toward and approximately to the lower panel, (d) an inner panel extending upwardly and outwardly from the downwardly extending inner panel, and approximately to the inwardly extending outer panel, at an acute angle relative to the downwardly extending inner panel, (e) and an inner panel extending inwardly from the upwardly and outwardly extending inner panel, and approximately to the downwardly extending inner panel, wherein the pallet stringer is combined with a decking member extending through aligned apertures in the upwardly extending outer panels, the downwardly extending inner panels, and the upwardly and outwardly extending inner panels, the decking member being secured adhesively to the inwardly extending inner panels, each inwardly extending inner panel having a tab extending into at least one of said apertures, above the decking member.

8. A pallet stringer folded from a single sheet of paperboard material so as to have at least eleven panels, which include five panels on each side of a generally vertical plane and a lower panel intersected by the generally vertical plane, wherein the panels on each side include (a) an outer panel extending upwardly from the lower panel, (b) an outer panel extending inwardly from the upwardly extending panel, toward and approximately to the generally vertical plane, (c) an inner panel extending downwardly from the inwardly extending outer panel, toward and approximately to the lower panel, (d) an inner panel extending upwardly and outwardly from the downwardly extending inner panel, and approximately to the inwardly extending outer panel, at an acute angle relative to the downwardly extending inner panel, (e) and an inner panel extending inwardly from the upwardly and outwardly extending inner panel, and approximately to the downwardly extending inner panel, wherein the pallet stringer is combined with a decking member extending through aligned apertures in the upwardly extending outer panels, the downwardly extending inner panels, and the upwardly and outwardly extending inner panels, the decking member being secured adhesively to the inwardly extending inner panels, each inwardly extending inner panel having tabs extending into the aligned apertures in the upwardly extending outer panel and the downwardly extending inner panel, above the decking member.

9. A pallet stringer folded from a single sheet of paperboard material so as to have at least eleven panels, which include five panels on each side of a generally vertical plane and a lower panel intersected by the generally vertical plane, wherein the panels on each side include (a) an outer panel extending upwardly from the lower panel, (b) an outer panel extending inwardly from the upwardly extending panel, toward and approximately to the generally vertical plane, (c) an inner panel extending downwardly from the inwardly extending outer panel, toward and approximately to the lower panel, (d) an inner panel extending upwardly and outwardly from the downwardly extending inner panel, and approximately to the inwardly extending outer panel, at an acute angle relative to the downwardly extending inner panel, (e) and an inner panel extending inwardly from the upwardly and outwardly extending inner panel, and approximately to the downwardly extending inner panel, wherein each inwardly extending inner panel has a tab extending into an aperture in at least one of the upwardly extending outer and downwardly extending inner panels.

10. The pallet stringer of claim 9 wherein each inwardly extending inner panel has tabs extending into apertures in the upwardly extending outer panel and the downwardly extending inner panel.

* * * * *